US008019261B2

(12) United States Patent
Tamaki

(10) Patent No.: US 8,019,261 B2
(45) Date of Patent: Sep. 13, 2011

(54) IMAGE FORMING APPARATUS

(75) Inventor: Masayuki Tamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/721,863

(22) Filed: Mar. 11, 2010

(65) Prior Publication Data

US 2010/0166468 A1 Jul. 1, 2010

Related U.S. Application Data

(62) Division of application No. 11/953,498, filed on Dec. 10, 2007, now Pat. No. 7,729,650.

(30) Foreign Application Priority Data

Dec. 12, 2006 (JP) ..... 2006-334601

(51) Int. Cl.
*G03G 15/01* (2006.01)

(52) U.S. Cl. ..... 399/299

(58) Field of Classification Search ..... 399/38, 399/66, 297–301
See application file for complete search history.

(56) References Cited

U.S. PATENT DOCUMENTS

| | | | | |
|---|---|---|---|---|
| 5,678,150 | A | 10/1997 | Takahashi et al. | |
| 5,926,669 | A | 7/1999 | Sugimoto et al. | |
| 6,498,910 | B2 | 12/2002 | Haneda et al. | |
| 7,260,347 | B2 | 8/2007 | Tamaki et al. | |
| 7,383,016 | B2 * | 6/2008 | Lee et al. | 399/400 |
| 7,398,024 | B2 * | 7/2008 | Ishihara | 399/21 |
| 2008/0063421 | A1 | 3/2008 | Tamaki | |

FOREIGN PATENT DOCUMENTS

| | | | |
|---|---|---|---|
| JP | 5-35038 | A | 2/1993 |
| JP | 6-110343 | A | 4/1994 |
| JP | 7-114241 | A | 5/1995 |
| JP | 8-220821 | A | 8/1996 |
| JP | 9-114181 | A | 5/1997 |
| JP | 2001-318499 | A | 11/2001 |
| JP | 2002-62692 | A | 2/2002 |
| JP | 2003-57918 | A | 2/2003 |
| JP | 2004-29514 | A | 1/2004 |
| JP | 2006-220800 | A | 8/2006 |
| JP | 2007-322492 | A | 12/2007 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a first image carrying member for carrying a first toner image; a second image carrying member for carrying a second toner image in a maximum amount, of the second toner image carried on the second image carrying member, larger than a maximum amount of the first image carried on the first image carrying member; a first transfer member for electrostatically transferring the first toner image onto a transfer medium in a first transfer nip formed by bringing the transfer medium into contact with the first, image bearing member; and a second transfer member for electrostatically transferring the second toner image onto the transfer medium in a second transfer nip formed by bringing the transfer medium into contact with the second bearing member so that a length of the second transfer nip with respect to a movement direction of the transfer member is longer than a length of the first transfer nip with respect to the movement direction.

3 Claims, 9 Drawing Sheets

IMAGE FORMING APPARATUS

This application is a divisional of U.S. patent application Ser. No. 11/953,498, filed Dec. 10, 2007.

FIELD OF THE INVENTION AND RELATED ART

The present invention relates to an image forming apparatus in which an amount of a toner (toner amount) per unit area with respect to a toner image carried on an image carrying member, as in an image forming apparatus using dark color and light color toners having the same hue and different densities, a transparent toner, and a white toner. Particularly, the present invention relates to an image forming apparatus for satisfactorily transferring a toner image having a large toner amount (per unit area) onto an intermediary transfer member or the like.

An image forming apparatus for forming an image by combining a particular color toner image with the transparent toner or the white toner and ordinary color toner images with a yellow toner, a magenta toner, a cyan toner, and a black toner has been put into practical use. Further, an image forming apparatus using dark color toners and light color toners having the same hue and different densities, such as a dark magenta toner and a light magenta toner.

Japanese Laid-Open Patent Application (JP-A) Hei 05-35038 discloses an image forming apparatus including four developing apparatuses using dark color toners of cyan, magenta, yellow, and black and two developing apparatuses using light color toners of cyan and magenta. In this image forming apparatus, toner images of these six colors are successively formed on one photosensitive drum and successively transferred onto a recording material carried on a recording material drum in a superposition manner. As a result, graininess in a low density area of an image is eliminated, so that it is possible to effect smooth toner gradation printing.

JP-A Hei 08-220821 discloses an image forming apparatus including four developing apparatuses using ordinary color toners of cyan, magenta, yellow, and black and one developing apparatus using a transparent toner. In this image forming apparatus, toner images of these fine colors are successively formed on one photosensitive drum and successively transferred onto a recording material carried on a recording material drum in a superposition manner. As a result, gloss is imparted to a white portion at which the recording material is exposed, thereby to reduce non-uniformity of the gloss with respect to the entire recording material.

JP-A Hei 07-114241 discloses an image forming apparatus including four developing apparatuses using ordinary color toners of cyan, magenta, yellow, and black and one developing apparatus using a white toner. The image forming apparatus is of a tandem type constituted by arranging five photosensitive drums different in developing color in a line at an upper linear section of a recording material conveying belt. In the image forming apparatus, toner images of these five colors are successively transferred onto a recording material conveyed by the recording material conveying belt in a superposition manner. As a result, a recording material-exposed portion is colored white, so that white representation even on a colored recording material.

JP-A Hei 06-110343 discloses a tandem type image forming apparatus in which four photosensitive drums for forming toner images with ordinary color toners of cyan, magenta, yellow, and black are arranged in a is line at an upper linear section of a recording material conveying belt. In the image forming apparatus, by applying a transfer voltage to a transfer roller press-contacting an associated photosensitive drum through the recording material conveying belt, the toner image is transferred from the photosensitive drum onto the recording material on the recording material conveying belt. The transfer voltage is constant current-controlled so as to keep a transfer current at a constant level, so that toner image formation and toner image transfer for each of the colors are equivalently performed by each of equivalently constituted photosensitive drums and each of equivalently constituted transfer portions, respectively.

However, the toner images formed on the photosensitive drums with the above-described light color toners, the transparent toner, and the white toner have a large toner amount than those with the ordinary color toners due to their intended purposes. When the toner images having the larger toner amount and the toner images having the smaller toner amount and transferred onto an intermediary transfer member on the same transfer condition, a toner image with a larger toner amount provides a lower transfer efficiency (as shown in FIG. 6). As a result, the amount of the toner transferred onto the intermediary transfer member is insufficient.

SUMMARY OF THE INVENTION

A principal object of the present invention is to provide an image forming apparatus which requires less increase in driving force for driving an intermediary transfer member or the like when a transfer efficiency of a toner image with a larger toner amount per unit area is enhanced.

According to an aspect of the present invention, there is provided an image forming apparatus comprising:

a first image carrying member for carrying a first toner image;

a first transfer member for electrostatically transferring the first toner image onto a transfer medium in a first transfer nip formed by bringing the transfer medium into contact with the first image bearing member;

a second image carrying member for carrying a second toner image in a maximum amount, of the second toner image carried on the second image carrying member, larger than a maximum amount of the first image carried on the first image carrying member; and a second transfer member for electrostatically transferring the second toner image onto the transfer medium in a second transfer nip formed by bringing the is transfer medium into contact with the second bearing member so that a length of the second transfer nip with respect to a movement direction of the transfer member is longer than a length of the first transfer nip with respect to the movement direction.

According to another aspect of the present invention, there is provided an image forming apparatus comprising:

a first image carrying member for carrying a first toner image formed with a dark color toner;

a second image carrying member for carrying a second toner image formed with a light color toner which has the same hue as and a different density from the dark color toner;

a first transfer member for electrostatically transferring the first toner image onto a transfer medium in a first transfer nip formed by bringing the transfer medium into contact with the first image bearing member; and a second transfer member for electrostatically transferring the second toner image onto the transfer medium in a second transfer nip formed by bringing the transfer medium into contact with the second bearing member so that a length of the second transfer nip with respect to a movement direction of the transfer member is longer than a length of the first transfer nip with respect to the movement direction.

According to a further aspect of the present invention, there is provided an image forming apparatus comprising:

a first image carrying member for carrying a first toner image formed with a toner of a primary color hue or a black hue;

a second image carrying member for carrying a second toner image formed with a white toner;

a first transfer member for electrostatically transferring the first toner image onto a transfer medium in a first transfer nip formed by bringing the transfer medium into contact with the first image bearing member; and a second transfer member for electrostatically transferring the second toner image onto the transfer medium in a second transfer nip formed by bringing the transfer medium into contact with the second bearing member so that a length of the second transfer nip with respect to a movement direction of the transfer member is longer than a length of the first transfer nip with respect to the movement direction.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, an image forming apparatus as an embodiment of the present invention will be specifically described with reference to the drawings. The image forming apparatus according to the present invention is capable of being realized in other embodiments in which a part or all of constitutions of Embodiments described below are replaced with their alternative constitutions so long as a length (width) of a transfer nip is increased to enhance a resultant this embodiment.

In this embodiment, an image forming apparatus forms a full-color image by using two photosensitive drums for forming toner images with light color toners of magenta and cyan in addition to four photosensitive drums for forming dark color toner images. However, the present invention may also be carried out by an image forming apparatus in which a photosensitive drum for forming a transparent toner image is disposed, an image forming apparatus in which a photosensitive drum for forming a white toner image is disposed, an image forming apparatus in which four or more photosensitive drums including a photosensitive drum for forming an intermediate color image are disposed, or the like. The present invention can also be carried out by mutually replacing an intermediary transfer belt and an intermediary transfer drum and/or replacing a recording material conveying belt and a recording material conveying drum.

In this embodiment, only a major part of the image forming apparatus with respect to formation and transfer of a toner image will be described. However, the image forming apparatus of the present invention can be carried out corresponding to various uses such as a printer, various printing machines, a copying machine, a facsimile apparatus, a multifunction processing machine by adding necessary apparatuses and casings.

With respect to constitutions of the image forming apparatuses described in the above-mentioned JP-A Hei 05-35038, JP-A Hei 08-220821, JP-A Hei 07-114241, and JP-A Hei 06-110343; respective mounted power sources; detailed structure of equipment; controls; and the like; general redundant descriptions will be omitted by partially omitting illustration with drawings.

First Embodiment

Image Forming Apparatus

Figure 1:
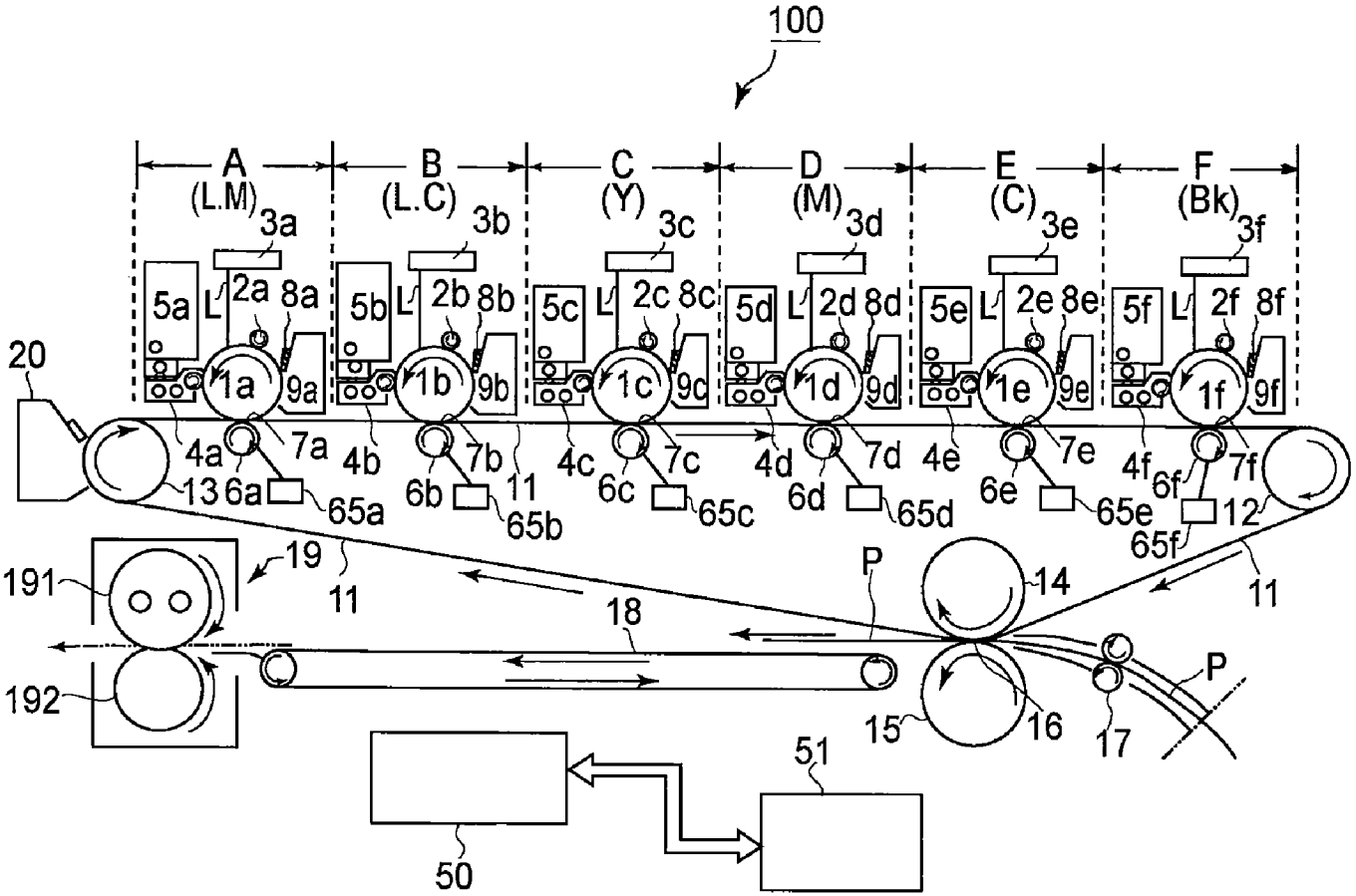
FIG. 1 is a schematic view for illustrating a general constitution of an image forming apparatus in First Embodiment.
Figure 2:
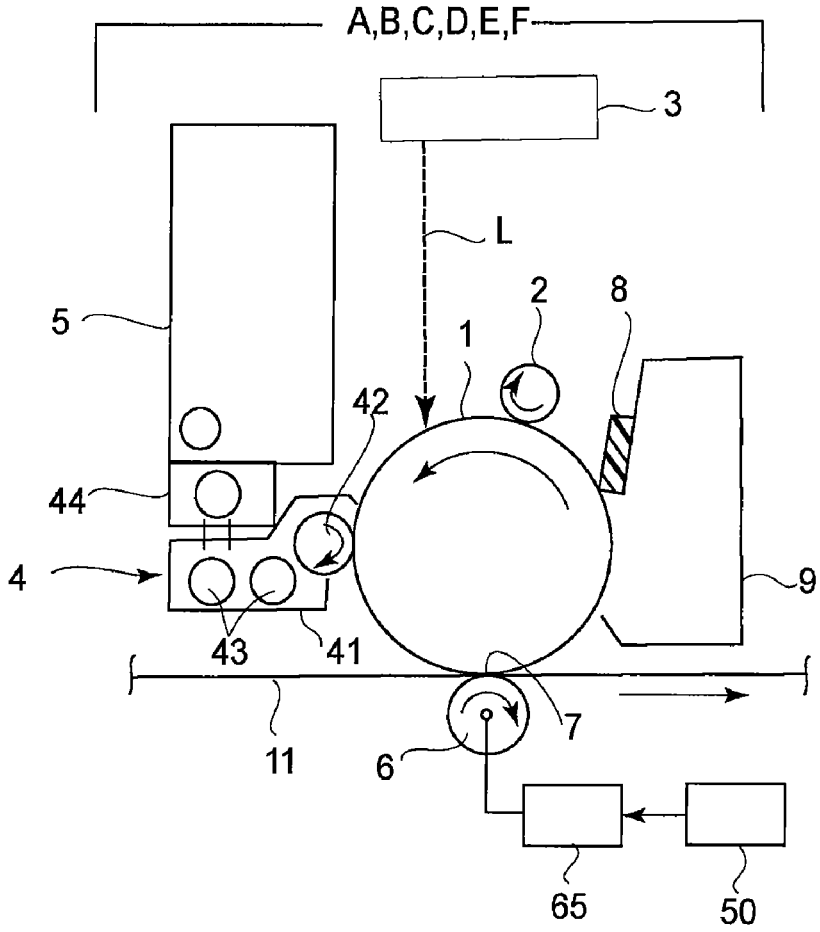
FIG. 2 is an enlarged view of one image forming station.

FIG. 1 is a schematic view for illustrating a general structure of an image forming apparatus of the First Embodiment, and FIG. 2 is an enlarged view for illustrating one of the image forming stations. As shown in FIG. 1, an image forming apparatus 100 of transfer efficiency is an electrophotographic full-color copying machine, using an intermediary transfer belt 11 of a six-drum type (inline type or tandem type). This image forming apparatus can output a full-color image on a sheet-like recording material P, such as various paper, OHP sheet, fabric, or the like.

A control portion 50 (a specific constitution thereof is omitted) integratedly controls the image forming apparatus 50 by being provided with an arithmetic function, an image processing function, drivers, an I/O circuit and the like. A reader portion 51 (a specific constitution thereof is omitted) is controlled by the control portion 50 and performs photoelectric reading of a color original and color separation to output electrical image information to the control portion 50.

In an upper linear section of an intermediary transfer belt 11 (transfer medium), image forming stations A, B, C, D, E and F are arranged in a line in a left-to-right direction in FIG. 1. These image forming stations A to F are different in color and primary transfer nips 7 (7*a* to 7*f*) described later but are substantially identical to electrophotographic process units of a laser scanning exposure type with respect to other constitutions. Accordingly, as shown in FIG. 2, description is commonly made to associated means or members in image stations A to F, by removing "a"-"f" from their reference numerals or symbols.

A photosensitive drum 1 is a drum type electrophotographic photosensitive member which is rotationally driven and has a diameter of 30-80 (mm). An image forming speed as a peripheral speed of the photosensitive drum 1 (a process speed of the image forming apparatus 100) is 200 (mm/sec) or more.

A charging roller 2 electrically uniformly charges the peripheral surface of the rotating photosensitive drum 1 to a predetermined polarity and a predetermined potential level.

An exposure apparatus (laser scanner) 3 scans (exposes) the uniformly charged surface of the photosensitive drum 1 by outputting a beam of laser light L modulated corresponding to image information signals, so that an electrostatic latent image corresponding to a pattern of the exposure is formed on the surface of the photosensitive drum 1.

A developing apparatus 4 develops the electrostatic latent image formed on the surface of photosensitive drum 1 into a toner image. A toner bottle 5 (toner cartridge, toner supply container) is a toner supply source detachably mountable to the developing apparatus 4.

A primary transfer roller (transfer member) 6 press-contacts a lower surface of the photosensitive drum (image carrying member) 1 with the presence of an intermediary transfer belt (transfer member) 11 therebetween and is rotated when the intermediary transfer belt 11 is moved in a direction indicated by an arrow. A contact portion between the photosensitive drum 1 and the intermediary transfer belt 11 is the primary transfer nip 7. To the transfer roller 6, a transfer voltage having a predetermined potential and a polarity opposite to the polarity of the toner charge is applied from a transfer bias application power source (voltage application means) 65. As a result, the toner image is transferred (primary transfer) from the surface of the photosensitive drum 1 onto the surface of the circularly moving intermediary transfer belt 11. A drum cleaning apparatus 8 cleans the surface of the photosensitive drum 1 by removing the toner remaining on the surface of the photosensitive drum 1 after the primary transfer onto the intermediary transfer belt 11. The rotating surface of the photosensitive drum 1 is repeatedly used for image formation after being cleaned by the cleaning apparatus 8. In this embodiment, the cleaning apparatus 8 is an elastic rubber blade (cleaning blade) which extends in the direction parallel to the generatrix of the photosensitive drum 1, and is in contact with the surface of the rotating photosensitive drum 1, being tilted so that its cleaning edge is on the upstream side of its base portion in terms of the rotational direction of the photosensitive drum 1. A waste toner container 9 retains the primary transfer residual toner removed from the surface of the photosensitive drum 1.

As shown in FIG. 1, the image forming stations A to F form, on the surfaces of the photosensitive drums 1*a* to 1*f*, toner images corresponding to color-separated component colors of an objective color original image. Specifically, toner images of light magenta (LM), light cyan (LC), yellow (Y), magenta (M), cyan (C), and black (Bk) and formed. Thus, the developing apparatuses 4*a* to 4*f* and the toner bottles 5*a* to 5*f* contain light magenta toner, light cyan toner, yellow toner, magenta toner, cyan toner, and black toner, respectively.

The intermediary transfer belt 11 is an endless flexible belt formed of resin or rubber. The intermediary transfer belt 11 is extended and is stretched around three parallel rollers, that is, a tension roller 12, a drive roller 13 and an image secondary transfer roller 14. The belt intermediary transfer belt 11 is driven by the tension roller 12 in the direction indicated by the arrows, at the substantially same speed as the rotational speed of the photosensitive drums 1*a* to 1*f*.

At a horizontal portion located between the tension roller 12 and the drive roller 13, the primary transfer nips 7*a* to 7*f* are located. In the primary transfer nips 7*a* to 7*f*, the primary transfer rollers 6*a* to 6*f* press the intermediary transfer belt 11 against the photosensitive drums 1*a* to 1*f*, respectively. The intermediary transfer belt 11 carries the primary transfer toner images successively formed thereon in a superposition manner in the primary transfer nips 7*a* to 7*f*. First, in the primary transfer nip 7*a* of the first image forming station A, the light magenta toner image, that is, the toner image of the first color formed, on the photosensitive drum 1*a*, is primary-transferred onto the surface of the intermediary transfer belt 11, which is being circularly driven. Next, in the primary transfer nip 7*b* of the second image forming station B, the light cyan toner image, that is, the toner image of the second color, is primary-transferred onto the light magenta toner image on the intermediary transfer belt 11 in a superposition manner. Similarly, in the primary transfer nips 7*c*-7*f* of the third to sixth image forming stations C to F, the yellow toner image, magenta toner image, cyan toner image, and black toner image, that is, the third to sixth colors, respectively, are sequentially transferred (primary transfer) onto the intermediary transfer belt 11 in the superposition manner.

That is, six toner images of light magenta, light cyan, yellow, magenta, cyan, and black are sequentially transferred in a multiple transfer manner onto the surface of the intermediary transfer belt 11 to form an unfixed full-color toner image.

Then, the unfixed full-color toner image on the intermediary transfer belt 11 is conveyed to a secondary transfer nip 16 by the subsequent circular movement of the intermediary transfer belt 11. The secondary transfer nip 16 is a contact position (portion) between a secondary transfer roller 15 and the intermediary transfer belt 11 and is a position between the inner secondary transfer roller 14 and secondary transfer roller 15.

Meanwhile, a sheet-like recording material P is fed with predetermined control timing from a sheet feeding cassette of an unshown sheet feeding mechanism, while being separated one by one, and then is conveyed to a pair of registration rollers 17, which are stopped in rotation, and a leading end of the recording material P is stopped by the nip between the pair of registration rollers 17. As a result, oblique movement of the recording material P is corrected. The recording material P is conveyed to the secondary transfer nip 16 by the rotational drive of the pair of registration rollers 17 with a timing synchronized with the movement of the unfixed full-color toner image on the intermediary transfer belt 11. That is, the start of rotation of the registration rollers 17 is controlled, with such timing that the leading end of the unfixed full-color toner image reaches the second transfer nip 16, so that the print-start position of the recording material P reaches the secondary transfer nip 16. While the recording material P is nipped and conveyed through the secondary transfer nip 16, a transfer voltage having a predetermined potential and the polarity opposite to the charge polarity of the toner is applied to the secondary transfer roller 15 from a transfer bias application power source (unshown). As a result, the unfixed full-color toner image on the intermediary transfer belt 11 is secondary-transferred at the same time onto the recording material P.

After being conveyed out of the secondary transfer nip 16, the recording material P is separated from the intermediary transfer belt 11 by the curvature of the intermediary transfer belt 11 and then is in turn conveyed on a conveying belt 18 to a fixing apparatus 19. The fixing apparatus 19 in this embodiment is a heat-pressure fixing apparatus which uses a roller pair consisting of a heat roller 191 and a pressure roller 192 as fundamental structural members. During a process in which the recording material P is conveyed through a fixing nip, that is, a contact portion between the heat roller 191 and the pressure roller 192, the recording material P is subjected to heat and pressure. As a result, the toners of the respective color toner images are melt-mixed and fixed on the recording material surface as a full-color print image (permanently fixed image). Then, the recording material P is discharged as a full-color print out of the image forming apparatus.

After the separation of the recording material P, the surface of the intermediary transfer belt 11 is cleaned by a belt cleaner 20 so that toner remaining on the surface of the intermediary transfer belt 11 after the secondary transfer is removed by the belt cleaner 20 to be readied for the subsequent image formation and primary transfer process.

In a monochromatic image forming mode (black-and-white mode), only the image forming station F for forming a black toner image is subjected to image formation, so that the black toner image formed on the photosensitive drum 1*f* is primary-transferred onto the intermediary transfer belt 11. In this case, at the image forming stations A to E, the photosensitive drums 1*a* to 1*e* are only rotated by the movement of the intermediary transfer belt 11 but are not subjected to the image forming operation. Then, the black toner image primary-transferred at the image forming station F is secondary-transferred onto the recording material P in the secondary transfer nip 16. The recording material P is separated from the intermediary transfer belt 11 and conveyed to the fixing apparatus 19, in which the black toner image is fixed on the recording material P. Then, the recording medium P is discharged as a monochromatic image print out of the image forming apparatus.

As shown in FIG. 2, the developing apparatus 4 is provided with a developing container 41 in which a developing sleeve 42 and developer stirring-conveying screws 43 are disposed and is also provided with a toner hopper 44 which is located on the top side of the developing container 41. A toner bottle 5, which is the toner supply source, is removably mounted on top of the toner hopper 44. The toner in the toner bottle 5 is supplied, as necessary, to the developing container 41 through the toner hopper 44 to compensate for the toner consumed in the developing container 41. The developer in the developing container 41 is of a one-component type or a two-component type.

The developing sleeve 42 is disposed opposite to the photosensitive drum 1 with a small gap between their surfaces, and is rotationally driven in a direction of the movement of the surface of the opposing photosensitive drum. The developer in the developing container 41 is stirred by the screws 43, and is carried by the rotating developing sleeve 42 to an opposing portion between the developing sleeve 42 and photosensitive drum 1. To the developing sleeve 42, a predetermined developing bias is applied from a developing bias application power source (unshown), so that the toner carried by the developing sleeve 42 is moved to the surface of the photosensitive drum 1. Electrostatic latent images are developed into respective color toner images by electrical deposition of respective color toners on the latent images.

Each of the image forming stations A to F is in the form of a process cartridge, which is detachably mountable to the main assembly of the image forming apparatus 100 and is prepared as one unit by integrally disposing the photosensitive drum 1, charging roller 2, developing apparatus 4, cleaning apparatus 8, and waste toner bin 9. Each process cartridge may also be designed as an ALL-IN-ONE process cartridge which further includes the toner bottle 5.

Figure 3:
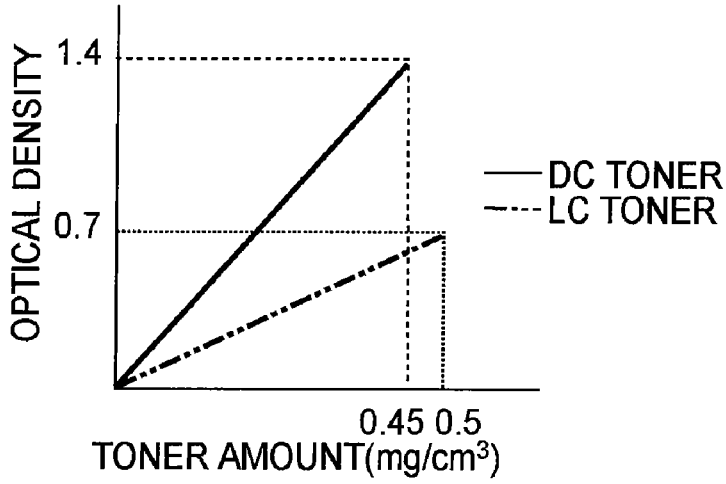
FIG. 3 is a graph showing a relationship between a toner amount and an optical density with respect to a light color toner and a dark color toner.
Figure 4:
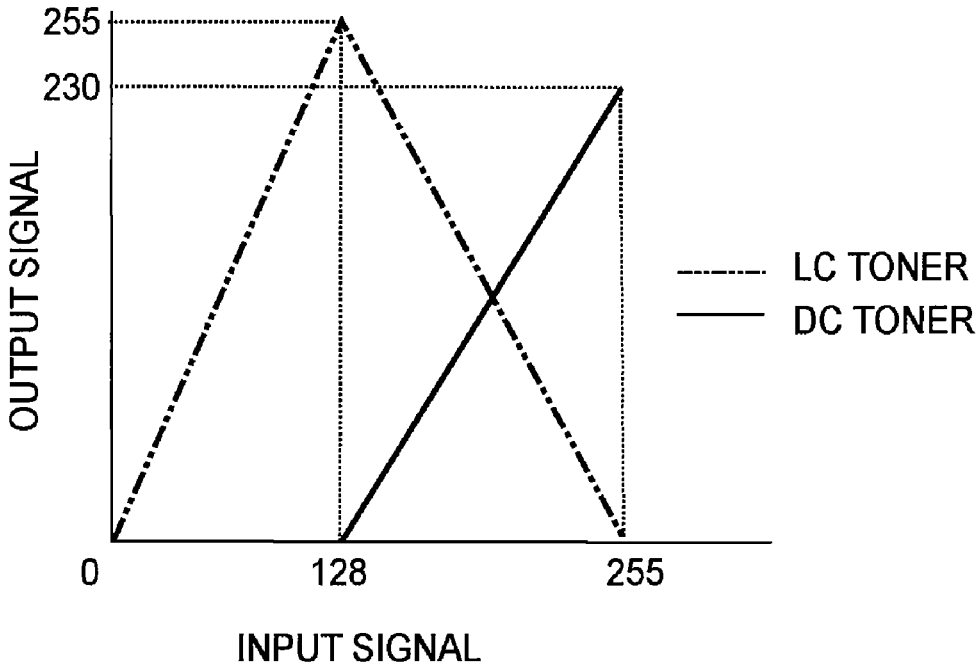
FIG. 4 is a graph showing a look-up table for assigning the light color toner and the dark color toner to an image density.
Figure 5:
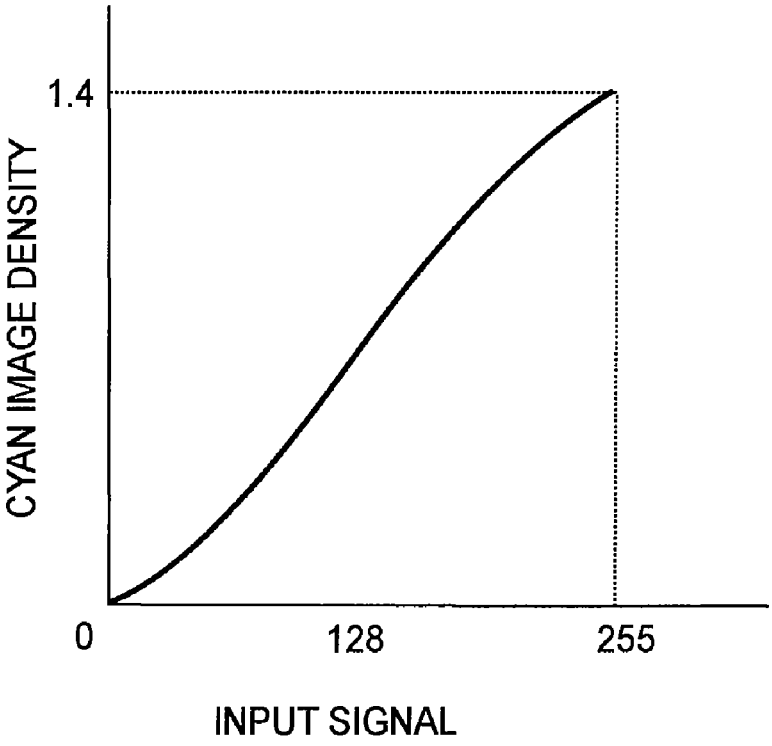
FIG. 5 is a graph showing a relationship between an image input signal value and an image density.
Figure 6:
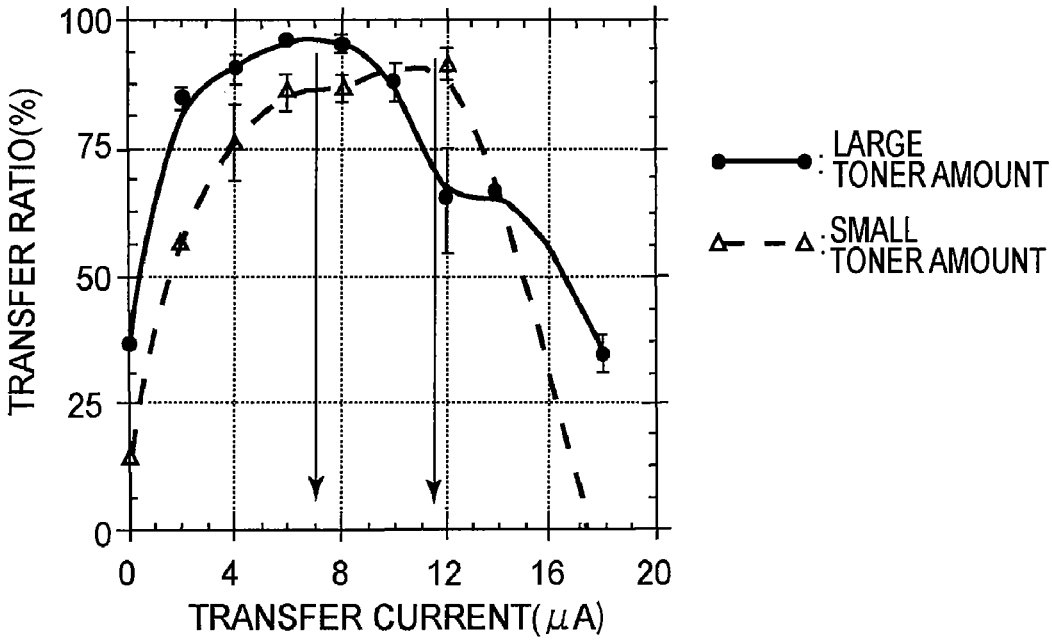
FIG. 6 is a graph showing a relationship between a transfer current and a transfer efficiency with respect to a large toner amount and a small toner amount.

FIG. 3 is a graph showing a relationship between a toner amount and an optical density with respect to a light color toner and a dark color toner, and FIG. 4 is a graph showing a look-up table for assigning the light color toner and the dark color toner to an image density. FIG. 5 is a graph showing a relationship between an image input signal value and an image density, and FIG. 6 is a graph showing a relationship between a transfer current and a transfer efficiency with respect to a large toner amount and a small toner amount, when the transfer nip has the same length (width).

In the following description, the image density (an optical density of an image after fixation) is measured by a spectrodensitometer (mfd. by X-Rite, Inc.). A measuring image is measured five times in an arbitrary manner and an average of the measured values is used as the image density.

A transfer efficiency is obtained from a change in image density (as measured by the above method) of a toner image on the photosensitive drum before and after the transfer operation. Each of the toner images carried on the photosensitive drum 1 before the transfer operation and a toner image carried on the photosensitive drum 1 after the transfer operation are removed by an adhesive tape (of polyester film), which is applied to transfer paper, followed by measurement of the image density.

When a density before the transfer operation is taken as Da, a density after the transfer operation is taken as Db, and a density of the tape alone is taken as Dc, the transfer efficiency is defined by the following equation:

$$\text{Transfer Efficiency (\%)}=\{[(Da-Dc)-(Db-Dc)]/(Da-Dc)\}\times 100$$

A large value means a higher transfer efficiency, i.e., a better transfer property.

Further, the amount of toner (toner amount) per unit area is obtained by sucking unfixed toner into a container having a predetermined shape and measuring a difference in weight between the containers before and after the suction and an sucking area, followed by division of the difference in container weight by the sucking area.

The light magenta toner and light cyan toner used by the first and second image forming stations A and B are designed so that when the toner amount per unit area on recording material P is 0.5 mg/cm$^2$, the optical density of the toner image is 0.7 after the fixation. The yellow, magenta, cyan, and black toners used by the third to sixth image forming stations C, D, E, and F are designed so that when the toner amount per unit area on recording material P is 0.45 mg/cm$^2$, the optical density of the toner image is 1.4 after the fixation. Hereafter, the light magenta toner and the light cyan toner are referred to as light color toners. Further, the image forming stations A and B are referred to as light color toner image forming stations. On the other hand, the yellow, magenta, cyan and black toners are referred to as dark color toners. Further, the image forming stations C to F are referred to as dark color toner image forming stations.

Herein, "light color toner" and "dark color toner" means two color toners which are equal in the spectral characteristics of the coloring agent (pigment or dye) which they contain, but, different in the amount of the coloring agent they contain. That is, the light color toner and the dark color toner are the same in hue, but are different in density. The light color toner may also be a color toner which has been adjusted in the amount of coloring agent so that when it is deposited on recording medium by 0.5 mg/cm$^2$, the optical density of the toner will is less than 1.0, whereas the dark color toner may also be a color toner which has been adjusted in the amount of coloring agent (pigment) so that when it is deposited on recording medium by 0.5 mg/cm$^2$, the optical density of the toner is not less than 1.0.

A purpose of adding the light color toner in color image formation which can be realized by using only the dark color toner is an image quality improvement by reducing a degree of graininess. FIG. 3 shows covering powers by the light cyan toner (LC toner: a chain double-dashed line) and the dark cyan toner (DC toner: a solid line). As shown in FIG. 3, when the toner amount of the light color toner on the recording material P is 0.5 (mg/cm$^2$), the optical density (O.D.) is 0.7, and when the toner amount of the dark color toner on the recording material P is 0.45 (mg/cm$^2$), the optical density is 1.4. Here, the toner amount (mg/cm$^2$) on the recording material is a measured value in an unified state, whereas the optical density is a measured value in a fixed state.

FIG. 4 shows a look-up table for the light color toner (a chain double-dashed line) and a look-up table of the dark color toner (a solid line) when an image is formed by using the light color toner and the dark color toner. In FIG. 4, an abscissa represents a gradation value of an image before separation into those for the dark color toner and the light color toner and an ordinate represents a gradation value of the image after the separation into those for the dark color toner and the light color toner. Here, the term "separation" means that image data for a certain color (version or channel) is divided into two image data for the dark color toner and the light color toner.

In this embodiment, when an electrostatic latent image is formed on the photosensitive drum 1, a time of irradiation of the photosensitive drum 1 with laser light L (light amount) is adjusted for forming one pixel, so that the toner amount on the photosensitive drum 1 is changed. A maximum toner amount on the photosensitive drums 1 at the image forming station A and B is adjusted to 0.5 (mg/cm$^2$) and a maximum toner amount on the photosensitive drums 1 at the image forming stations C to F is adjusted to 0.45 (mg/cm$^2$).

As shown in FIG. 4, data division into data for the dark color toner and the light color toner for obtaining a target image density (sharing of input signal values during latent image formation and development at the image forming stations B and E) is performed. On the basis of the two look-up tables shown in FIG. 4, the light color toner image and the dark color toner image are disposed in the superposition manner, so that it is possible to reproduce a gradation density of cyan faithful to an image input signal value as shown in FIG. 5.

As shown in FIG. 4, in the image forming apparatus 100, different from conventional image formation using only the dark color toner, the light color toner and the dark color toner are used in such a manner that the light color toner is predominantly used at a low density portion of the image signal and is used in mixture with the dark color toner in a medium density portion and the dark color toner is predominantly used in a high density portion. This is true for magenta image formation (at the image forming stations A and D).

As a result, the degree of graininess is reduced at the low density portion by increasing a dot density and the toner amount at the high density portion is suppressed, so that it is possible to realize a wide color reproduction range, from an intermediate tone area to a high lightness (brightness) area, which is important for outputting a natural image and the like. As a result, with respect to a photographic image predominantly using the intermediate tone area to the high lightness area, high-quality image formation is realized with smooth and natural gradation close to a silver halide photograph.

As a result of various studies by the present inventor on the conventional image forming apparatus using the four dark color toners and the two light color toners, it has been found that there arises the following problem in terms of a practical level and an operational level. For example, general photograph-like color images (including person, building, sky, sea, mountain, cloud, night view, vehicle, etc.) with about 2-10 million pixels were formed on several hundreds on the basis of the look-up tables shown in FIG. 4. As a result, an amount of consumption of the dark color toner was about 2.2 times that of the dark color toner.

That is, the light color toner in charge of intermediate tone reproduction required for a photographic quality is increased in consumed toner amount when compared with the dark color toner. In order to represent the same density, the light color toner requires a toner amount which is two times that in the case of using the dark color toner. Further, in some cases, in order to prevent an occurrence of pseudo contour due to discontinuity of a density area (connecting portion) in which the dark color toner and the light color toner are present in mixture, the density area in which the light color toner is used is extended in a wide range from a highlight portion to a high density portion. In these cases, compared with the dark color toner, the light color toner is further increased in consumed toner amount.

Further, when the natural image or the like required for the photographic quality is outputted, the area from the intermediary tone portion to the high lightness portion is important. For this reason, as shown in FIG. 4, in order to realize a wide color reproduction range from the intermediary tone area to the high lightness area and the reduction in degree of graininess, image formation is performed in the high lightness area (high light area) in which the gradation value is small by using only the light color toner. Also in this case, the consumed amount of the light color toner is larger than that of the dark color toner.

However, when the dark color toner and the light color toner are used in combination from the high light area, the degree of graininess in the high light area is undesirably decreased (i.e., the graininess of the toner is exhibited). Accordingly, at a gradation level of 0.3 or less in terms of the image density, it is preferable that only the light color toner is used and no dark color toner is used. Also in this case, the consumed amount of the light color toner is larger than that of the dark color toner.

Until a gradation value 128, the gradation level of the light color toner is increased and then, at gradation values exceeding 128, is decreased. On the other hand, with respect to the dark color toner, at the gradation values exceeding 128, the gradation level is increased. In other words, in the intermediate tone area, image formation is effected by using the light color toner and the dark color toner in combination and effected in the high density area by predominantly using the dark color toner, so that it is possible to realize the high density level in the high density area while suppressing the consumed toner amount of the light color toner.

The thus obtained image density curve is in a graph of FIG. 5. The abscissa represents the gradation value similarly as in FIG. 4 and the ordinate represents the image density. It is found that a good gradation reproducibility can be obtained by using only the light color toner in the high lightness area and using the dark color toner and the light color toner in combination in the intermediate tone area.

As described above, in order to realize the photographic quality of the photographic image for which the area from the intermediary tone portion to the high lightness portion is dominantly used, the consumption amount (toner amount per unit area on the photosensitive drum) of the light color toner is increased when compared with the dark color toner. Referring to FIG. 1, the toner amounts on the photosensitive drums 1*a* and 1*b* at the image forming stations A and B are larger than those on the photosensitive drums 1*c* to 1*f* at the image forming stations C to F.

However, in the primary transfer of the constant voltage type as shown in FIG. 2, when the toner amount on the photosensitive drum 1 is large, the transfer efficiency is liable to be lowered compared with the case of the small toner amount on the photosensitive drum 1. A relationship between a transfer current and the transfer efficiency with respect to the toner amount is shown in FIG. 6. In FIG. 6, a chain double-dashed line represents the case of a large toner amount of 0.5 (mg/cm$^2$) on the photosensitive drum 1 and a solid line represents the case of a small toner amount of 0.3 (mg/cm$^2$) on the photosensitive drum 1. As shown in FIG. 6, when the toner amount on the photosensitive drum 1 is large, the resultant transfer efficiency is generally lowered.

The reason why the transfer efficiency is lowered when the toner amount is large is as follows. A transfer current required to transfer the toner in the primary transfer is proportional to the product of a triboelectric charge amount of the toner and the toner amount on the photosensitive drum, so that a smaller transfer current is required for the case of the smaller toner amount and a larger transfer current is required for the case of the larger toner amount. For this reason, in the case where an excessively large transfer current is supplied, a charge polarity of a part of the toner transferred onto the transfer medium changes, so that such a phenomenon that the part of the toner is deposited on the photosensitive drum again (re-transfer phenomenon) is caused to occur. As a result, a lowering in transfer efficiency occurs.

Therefore, when the same primary transfer condition is employed at the light color toner image forming stations A and B and the dark color toner image forming stations C to F, the transfer efficiency is lowered at the light color toner image forming stations A and B compared with the dark color toner image forming stations C to F. As a result, an image quality is caused to be lowered, so that directly, the image density is lowered and unnecessary consumption of the toner is caused by a large amount of untransferred toner remaining on the photosensitive drum surface after the transfer process. Further, a load is exerted on the cleaning apparatus for removing the toner remaining on the photosensitive drum.

Figure 7:
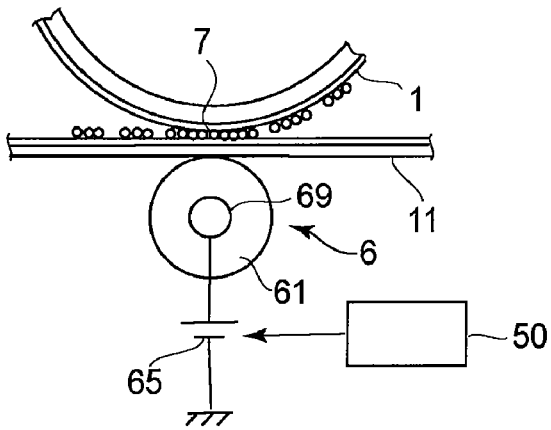
FIG. 7 is a schematic view for illustrating a primary transfer condition in First Embodiment.
Figure 8:
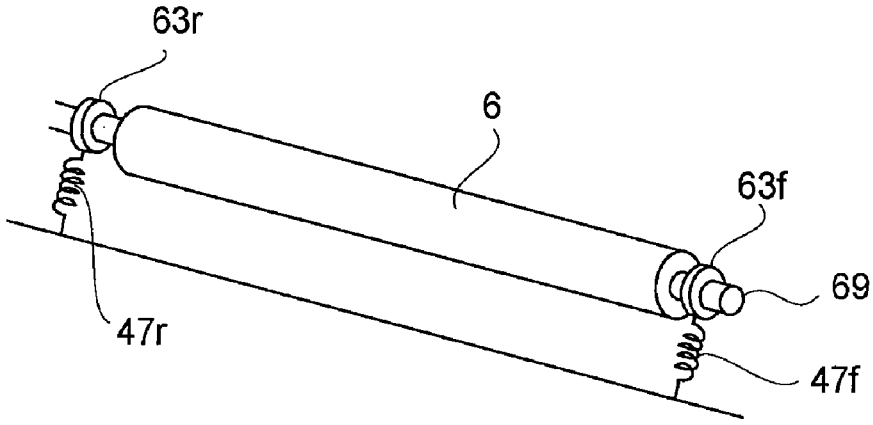
FIG. 8 is a perspective view of a primary transfer roller.
Figure 9:
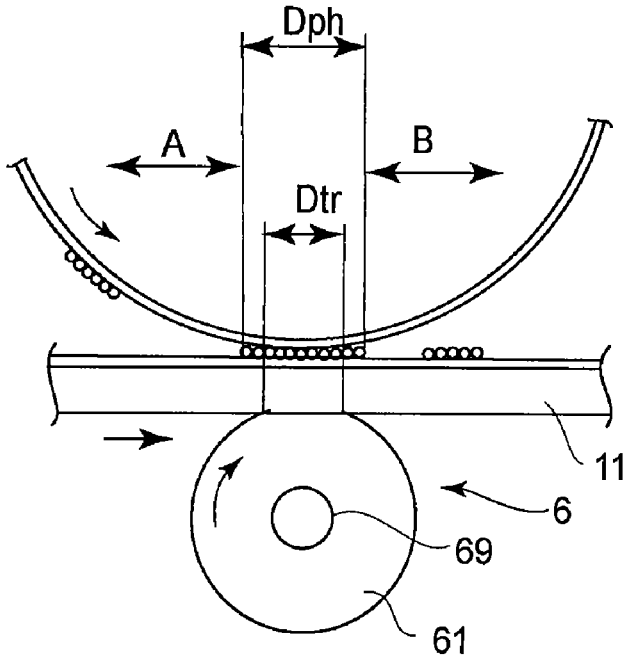
FIG. 9 is a schematic view for illustrating a length (width) of an intermediary transfer belt, contacting a photosensitive drum, with respect to a movement direction of the intermediary transfer belt.
Figure 10:
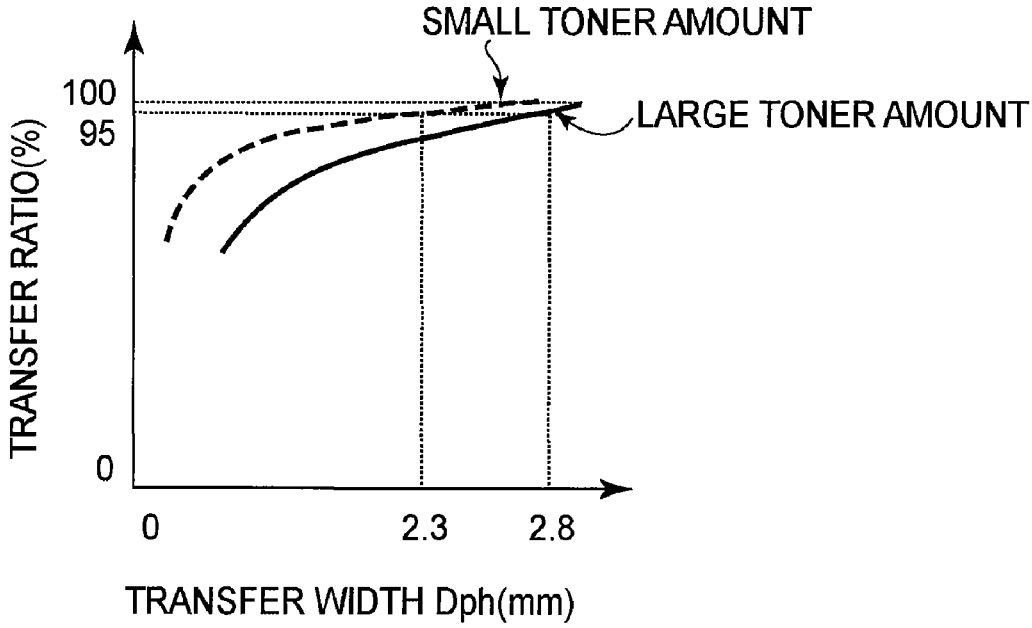
FIG. 10 is a graph showing a relationship between a transfer efficiency and a length of the intermediary transfer belt, contacting the photosensitive drum, with respect to the movement direction.

In this embodiment, the lowering in transfer efficiency is suppressed by increasing a press-contact force of the primary transfer roller 6 against the intermediary transfer belt 11 to increase a transfer area so as not to excessively increase a transfer current density even when the transfer current is increased. FIG. 7 is a sectional view for illustrating a primary transfer condition in this embodiment and FIG. 8 is a perspective view of the primary transfer roller. FIG. 9 is a sectional view is for illustrating a length (width) of the intermediary transfer belt 11 with respect to a movement direction of the intermediary transfer belt 11 in which the intermediary transfer belt 11 contacts the photosensitive drum 1, and FIG. 10 is a graph showing a relationship between the length (width) and the transfer efficiency.

Referring to FIG. 7, the primary transfer roller 6 is a 18 mm-diameter roller constituted by a metallic core member 69 and an elastic layer 61 formed of an electroconductive foamed urethane material at an outer peripheral surface of the core member 69. An electric resistance between the surfaces of the core member 69 and the elastic layer 61 is about 104 ohm. To the core member 69, the transfer bias application power source 65 is connected. When a hardness of the elastic layer 61 was measured according to the JIS-A hardness measuring method, a measured value was 45 degrees.

Referring to FIG. 8, the transfer roller 6 is rotated about the core member 69 as a rotation center shaft by receiving a driving force from an unshown motor. The core member 69 is supported by bearings 63*f* and 63*r* at both end portions thereof and the bearings 63*f* and 63*r* are provided with springs 47*f* and 47*r*, respectively. The springs 47*f* and 47*r* urges the core member 69 through the bearings 63*f* and 63*r*, so that the elastic layer 61 of the primary transfer roller 6 is elastically brought into contact with the inner surface of the intermediary transfer belt 6. As shown in FIG. 1, the constitutions of the primary transfer rollers 6*a* and 6*b* are substantially identical to those of the primary transfer rollers 6*c* to 6*f*. However, the primary transfer rollers 6*a* and 6*b* are different from the primary transfer rollers 6*c* to 6*f* in magnitude of an urging force exerted by the springs 47*f* and 47*r* shown in FIG. 8, i.e., a contact pressure between the intermediary transfer belt 11 and the photosensitive drum 1. In this embodiment (First Embodiment), as shown in Table 1 below, the urging force for the primary transfer rollers 6*a* and 6*b* is 10 (N) and the urging force for the primary transfer rollers 6*c* to 6*f* is 8 (N). In this case, the urging force is a total of the urging force exerted by the spring 47*f* and the urging force exerted by the spring 47*r* and the magnitude thereof is adjusted by changing an elastic strength of the springs 47*f* and 47*r*.

TABLE 1

| Transfer roller | Urging force (N) | Dtr*1 (mm) | Dph*2 (mm) |
|---|---|---|---|
| 6c to 6f | 8 | 2.1 | 2.3 |
| 6a, 6b | 10 | 2.6 | 2.8 |

*1Dtr represents a contact width (mm).
*2Dph represents a transfer width (mm).

In this embodiment, the urging force of the primary transfer rollers (second transfer members) 6*a* and 6*b* at the light color toner image forming stations A and B is larger than the urging force of the primary transfer rollers 6*c* to 6*f* at the dark color toner image forming stations C to F. As a result, at the light color toner image forming stations A and B, compared with the dark color toner image forming stations C to F, the elastic layer 61 is largely deformed as shown in FIG. 9 to increase the length with respect to the movement direction of the intermediary transfer belt 11, in which the elastic layer 61 contacts the intermediary transfer belt 11 (i.e., the contact width Dtr). The contact width Dtr is long, so that the length with respect to the movement direction of the intermediary transfer belt 11, in which the intermediary transfer belt 11 contacts the photosensitive drum 1 (i.e., the transfer width Dph) is also long at the image forming stations A and B compared with the image forming stations C to F. A result of measurement of the contact width Dtr and the transfer width Dph when the primary transfer is roller 6 is urged against the intermediary transfer belt 11 is shown in Table 1. The urging forces shown in Table 1 are determined in view of the transfer widths for providing a transfer efficiency of 95(%) or more.

The contact width Dtr means the length in the contact area between the intermediary transfer belt 11 and the primary transfer roller 6 with respect to the movement direction of the intermediary transfer belt 11. Further, the transfer width Dph means the length in the contact area (transfer nip) between the intermediary transfer belt 11 and the photosensitive drum 1 with respect to the movement direction of the intermediary transfer belt 11. The contact width Dtr is obtained by measuring an area of a developer (T) deposited on the primary transfer roller 6 after a developer-deposited portion is formed on the inner surface of the intermediary transfer belt 11 and caused to pass between the primary transfer roller 6 and the photosensitive drum 1 both in a stopped state. The transfer width Dph is obtained by measuring a width of an area of a developer deposited on the intermediary transfer belt 11 by rubbing between the photosensitive drum 1 and the intermediary transfer belt 11 when the developer is deposited on the photosensitive drum 1 and the photosensitive drum 1 is rotated on the intermediary transfer belt 11 placed in a fixed state.

FIG. 10 shows the relationship between the transfer width Dph and the transfer efficiency. As shown in FIG. 10, a larger toner amount (toner deposition amount) on the photosensitive drum 1 provides a lower transfer efficiency as described above. However, a longer (wider) transfer width Dph leads to a longer transferable time of the toner onto the intermediary transfer belt 11, so that a resultant transfer efficiency is increased.

Further, a transfer area in which a transfer electric fields acts is increased, so that an increase in transfer current density is suppressed even when the transfer current is increased depending on an increase in toner amount. As a result, the charge polarity of the part of the toner transferred onto the intermediary transfer belt 11 is less changed. Thus, the lowering in transfer efficiency caused by such a phenomenon that the toner is changed in charge polarity to be deposited on the photosensitive drum 1 again (re-transfer phenomenon) is alleviated.

The control portion 50 shown in FIG. 1 increases a magnitude of a bias voltage applied to the light color toner primary transfer rollers 6*a* and 6*b*, compared with that applied to the dark color toner primary transfer rollers 6*c* to 6*f*, within a range not causing improper transfer due to the electric discharge phenomenon. Further, the transfer bias application power sources 65*a* and 65*b* apply the transfer voltage to the primary transfer rollers 6*a* and 6*b*, respectively, so as to pass a current of 12 μA through the primary transfer rollers 6*a* and 6*b*. The transfer bias application power sources 65*c* to 65*f* apply the transfer voltage to the primary transfer rollers 6*c* to 6*f*, respectively, so as to pass a current of 10 μA through the primary transfer rollers 6*c* to 6*f*.

When the primary transfer was actually performed in the image forming apparatus 100 in this embodiment, a transfer efficiency of 95% was obtained in the primary transfer nips 7*a* and 7*b*, thus permitting good primary transfer. For comparison, when the urging force for the primary transfer rollers 6*a* and 6*b* was changed to 8 (N), the transfer efficiency in the primary transfer nips 7*a* and 7*b* was 85%.

In this embodiment, compared with the primary transfer nips 7*c* to 7*f* at the dark color transfer image forming stations C to F, in the primary transfer nips 7*a* and 7*b* at the light color toner image forming stations A and B, the urging force is large. As a result, good primary transfer can be carried out by always bringing the intermediary transfer belt 11 into contact with the photosensitive drum 1.

In this embodiment, the contact width Dtr and the transfer width Dph in the primary transfer nips 7*a* and 7*b* are larger than those in the primary transfer nips 7*c* to 7*f*. However, in any of the primary transfer nips 7*a* to 7*f*, Dtr≦Dph is satisfied.

The contact width Dtr may desirably be increased while satisfying Dtr≦Dph. This is because in the case of Dtr>Dph, the transfer electric field also acts on area A and area B in which the intermediary transfer belt 11 and the photosensitive drum 1 do not contact each other. Particularly, in the case where the transfer electric field acts on the upstream area A, a part of the toner image formed on the photosensitive drum 1 is undesirably scattered on the intermediary transfer belt 11. Accordingly, Dtr≦Dph is desirable.

In this embodiment, all the hardnesses of the elastic layers 61 of the primary transfer rollers 6 are equal to each other, so that it is possible to easily set a necessary difference in transfer width Dph by providing a difference in urging force among the primary transfer rollers 6. Specifically, the urging force for the primary transfer rollers 6*a* and 6*b* at the light color toner image forming stations A and B is increased by 2(N) compared with the urging force for the primary transfer rollers 6*c* to 6*f* at the dark color toner image forming stations C to F. As a result, the transfer width Dph of 2.8 mm for the light color toner is set to be larger than the transfer width Dph of 2.3 mm for the dark color toner without excess and deficiency.

However, the transfer width setting method is not particularly limited thereto but the necessary difference in transfer width Dph may also be set, e.g., by selecting two values of the hardnesses of the elastic layers 61 of the primary transfer rollers 6 while uniformizing the urging forces for all the primary transfer rollers 6. The necessary difference in transfer width Dph may also be set by combining the hardnesses of the elastic layers 61 of the primary transfer rollers 6 with the adjustment of the urging forces for the primary transfer rollers 6.

As the material for the intermediary transfer belt 11, it is possible to use a semiconductor material having a volume resistivity of 108-1013 ohm·cm. For example, it is possible to use a film of polyimide in which carbon black particles are dispersed and other films of polyethyleneterephthalate, polycarbonate, polytetrafluoroethylene, etc., in which electroconductive particles such as carbon black particles are dispersed. It is also possible to use a polymeric film adjusted in electric resistance by composition adjustment without using the electroconductive particles. Further, a polymeric film in which an ion conductive substance is added or a rubber material such as a silicone rubber or an urethane rubber having a relatively low electric resistance may also be used. Also as the material for the primary transfer rollers 6, it is possible to use various rubber materials such as the urethane rubber and the silicon rubber.

Incidentally, when the contact width Dtr and the transfer width Dph are increased at all the image forming stations A to F, a driving torque for circularly moving the intermediary transfer belt 11 is increased, thus resulting in an increased electric power consumption.

Further, problems on an output image caused due to the increase in transfer width Dph (such as scattering and graininess) are noticeable with respect to the dark color toners, so that an effect of image quality improvement by improving the transfer efficiency for the light color toner is cancelled as a whole. Further, the dark color toners are used for development in a small toner amount, so that the transfer efficiency is originally high. Thus, the resultant transfer efficiency is not so improved even when the transfer width Dph is further increased.

On the other hand, the above-described problems (scattering and graininess) due to the increase in transfer width Dph for the light color toner are not noticeable compared with those for the dark color toner but the light color toner is used for development in a large amount, so that the effect by the increase in transfer width Dph is remarkably large. With respect to the transfer of the light color toner, the transfer of a solid image of the light color toner onto the recording material P with reliability (an improvement in this embodiment) is most important.

Based on the above-described factors, in this embodiment, the contact width Dtr and the transfer width Dph are increased in the primary transfer nips 7 only at the light color toner image forming stations A and B. In other words, at the dark color toner image forming stations C to F, the contact width Dtr and the transfer width Dph in the primary transfer nips 7 are decreased.

Here, a relationship between the transfer width Dph in the primary transfer nip 7 and the scattering will be described. The scattering occurs at a front transfer gap portion (an upstream portion of the transfer nip) in the area A shown in FIG. 9. When the transfer width Dph in the primary transfer nip 7 is increased, a distance between the intermediary transfer belt 11 and the photosensitive drum 1 is decreased at the front transfer gap portion, so that an electric field acting on the front transfer gap portion is further increased, thus worsening the scattering phenomenon.

Further, electric charges of a polarity identical to the charge polarity of the toner image are accumulated on the surface of the intermediary transfer belt 11 during the superposition of the toner images of the second color, the third color, . . . , on the toner image of the first color on the intermediary transfer belt 11. For this reason, particularly during the primary transfer at the final image forming station F, an electric field is generated at the front transfer gap portion in such a direction that the toner image on the photosensitive drum if is moved toward the intermediary transfer belt 11, thus worsening the scattering phenomenon.

Second Embodiment

Figure 11:
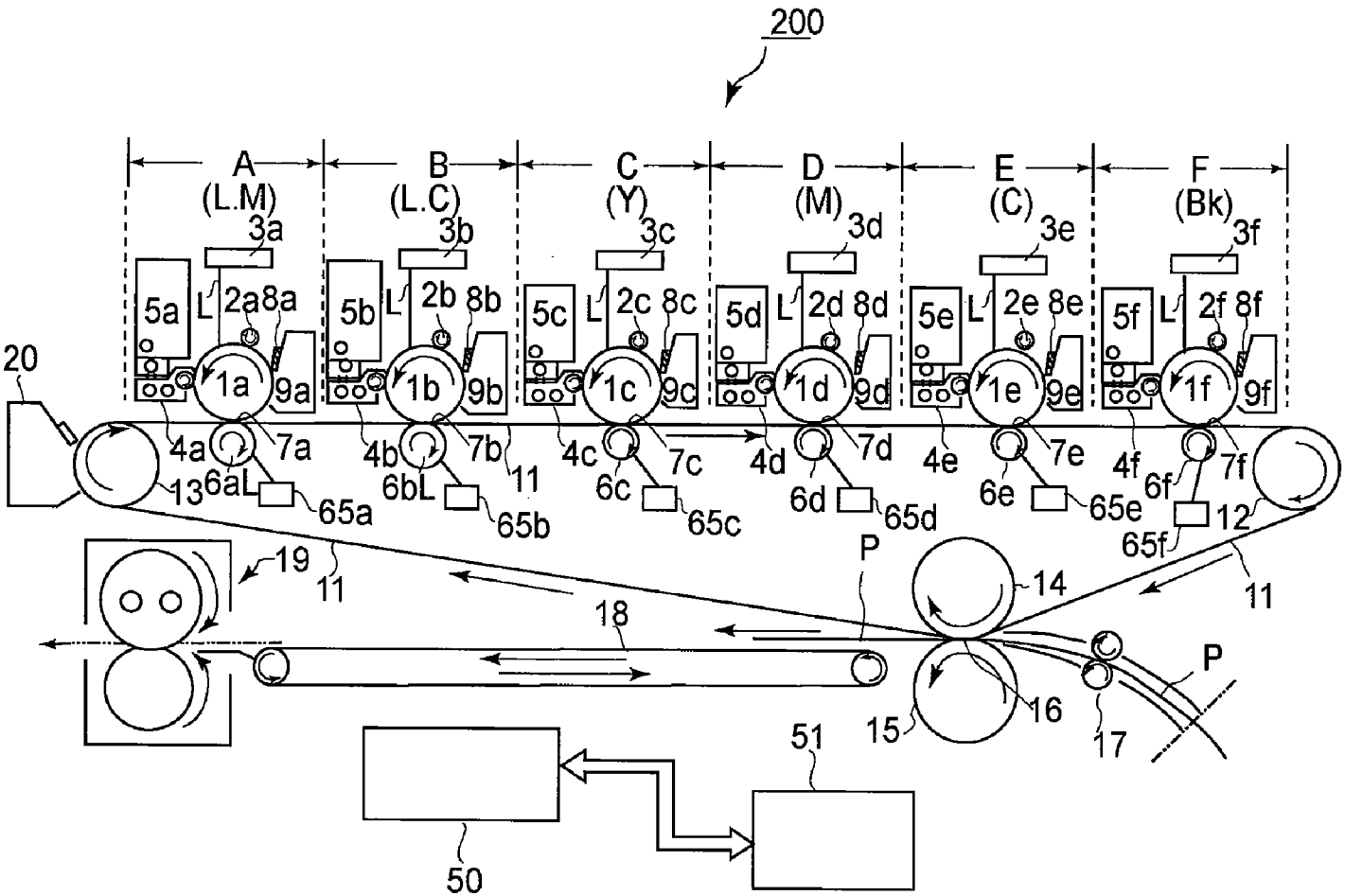
FIGS. 11, 12 and 13 are schematic views for illustrating general constitutions of image forming apparatuses in Embodiments 2, 3 and 4, respectively.

FIG. 11 is a schematic view for illustrating a general constitution of an image forming apparatus of the Second Embodiment. In this embodiment, a transfer width Dph for primary transfer rollers 6*a*L and 6*b*L is set to be substantially equal to that in the First Embodiment by increasing diameters of the primary transfer rollers 6*a*L and 6*b*L. Other constitutions and control are identical to those in the First Embodiment, so that those shown in FIGS. 2 to 10 are similarly applied in this embodiment. Further, means or members common to those shown in FIG. 1 are represented by reference numerals or symbols common to those shown in FIG. 1 and redundant description is omitted.

An image forming apparatus 200 in this embodiment includes the primary transfer rollers 6*a*L and 6*b*L, for light color toners, different in diameter from primary transfer rollers 6*c* to 6*f* for dark color toners. The light color toner primary transfer rollers 6*a*L and 6*b*L have a diameter of 22 mm and the dark color toner primary transfer rollers 6*c* to 6*f* have a diameter of 16 mm.

All the primary transfer rollers 6*a*L, 6*b*L, 6*c*, 6*d*, 6*e* and 6*f* are urged against the inner surface of the intermediary transfer belt 11 and all the urging forces exerted by the springs 47*f* and 47*r* shown in FIG. 8 are 8(N). In this embodiment, the contact widths Dtr and the transfer widths Dph are those shown in Table 2 below. Specifically, in the primary transfer nips 7*a* and 7*b*, the contact width Dtr is 2.8 mm and the transfer width Dph is 2.8 mm. Further, in the primary transfer nips 7*c* to 7*f*, the contact width Dtr is 2.1 mm and the transfer width Dph is 2.3 mm.

TABLE 2

| Transfer roller | Urging force (N) | Dtr (mm) | Dph (mm) |
|---|---|---|---|
| 6c to 6f | 8 | 2.1 | 2.3 |
| 6aL, 6bL | 8 | 2.8 | 2.8 |

In this embodiment, all the urging forces for the primary transfer rollers 6*a*L, 6*b*L, and 6*c* to 6*f* are equal but the diameter of the light color toner primary transfer rollers 6*a*L and 6*b*L are larger than that of the dark color toner primary transfer rollers 6*c* to 6*f*. For this reason, at the light color toner image forming stations A and B, the contact length between the photosensitive drum 1 and the intermediary transfer belt 11 is larger than that at the dark color toner image forming stations C to F, so that stable primary transfer can be performed.

In this embodiment, the diameter of the light color toner primary transfer rollers 6*a*L and 6*b*L is larger than that of the dark color toner primary transfer rollers 6*c* to 6*f*, so that a difference in transfer width Dph is set to be substantially equal to that in First Embodiment.

In this embodiment, the diameter of the light color toner primary transfer rollers 6*a*L and 6*b*L is larger than that of the dark color toner primary transfer rollers 6*c* to 6*f*, so that it is possible to obtain a sufficient transfer performance even in a large toner amount on the photosensitive drums 1*a* and 1*b*. This is because a larger diameter of the primary transfer roller 6 provides a longer transfer time and leads to uniform transfer electric field and uniform pressing force, thus improving transferability. Further, it is possible to ensure a large transfer current depending on a large amount of toner to be transferred without increasing the transfer current density, so that a lowering in this embodiment due to polarity inversion of the toner transferred onto the intermediary transfer belt 11 is alleviated. Accordingly, even when the toner amount is large, the lowering in this embodiment on the output image is less noticeable.

Further, the transfer electric field is perpendicular to the transfer direction, so that image disturbance due to distortion of the electric field is less generated.

However, when the diameter of the primary transfer roller 6 is excessively increased, a toner image pressing time is increased, so that image disturbance due to mechanical vibration or the like is increased. For this reason, although depending on the diameter of the photosensitive drum 1, in the case of the First Embodiment, it is desirable that the diameter of the primary transfer roller 6 is 30 mm or less. Further, with respect to the dark color toner for which the image disturbance is noticeable compared with the case of the light color toner, the diameter of the primary transfer roller 6 may desirably be small.

The constitutions of the First Embodiment and the Second Embodiment may also be combined. In the constitution in which the diameter of the light color toner primary transfer rollers 6*a*L and 6*b*L is made larger than the diameter of the dark color toner primary transfer rollers 6*c* to 6*f*, the springs 47*f* and 47*r* shown in FIG. 8 is strengthened at the image forming stations A and B compared in the those at the image forming stations C to F. By this constitution, the primary transfer rollers 6*a*L and 6*b*L at the image forming stations A and B further stably contact the photosensitive drums 1*a* and 1*b* to realize an improvement in this embodiment. However, also in such a case, the relationship: Dtr≦Dph may desirably be satisfied as described above.

For the same reason as in the First Embodiment, in this embodiment, the contact width Dtr and the transfer width Dph in the primary transfer nips 7 are increased only at the light color toner image forming stations A and B. The contact width Dtr and the transfer width Dph in the primary transfer nips at the dark color toner image forming stations C to F is decreased.

Third Embodiment

In the First and Second Embodiments, the image forming apparatuses 100 and 200 which use the light color toners and the dark color toners in combination are described. However, the present invention is similarly applicable to an image forming apparatus of this embodiment in which an image is formed by combining a toner image with the dark color toners and achieves a transfer efficiency improving effect equal to or larger than those in the First and Second Embodiments.

Figure 12:
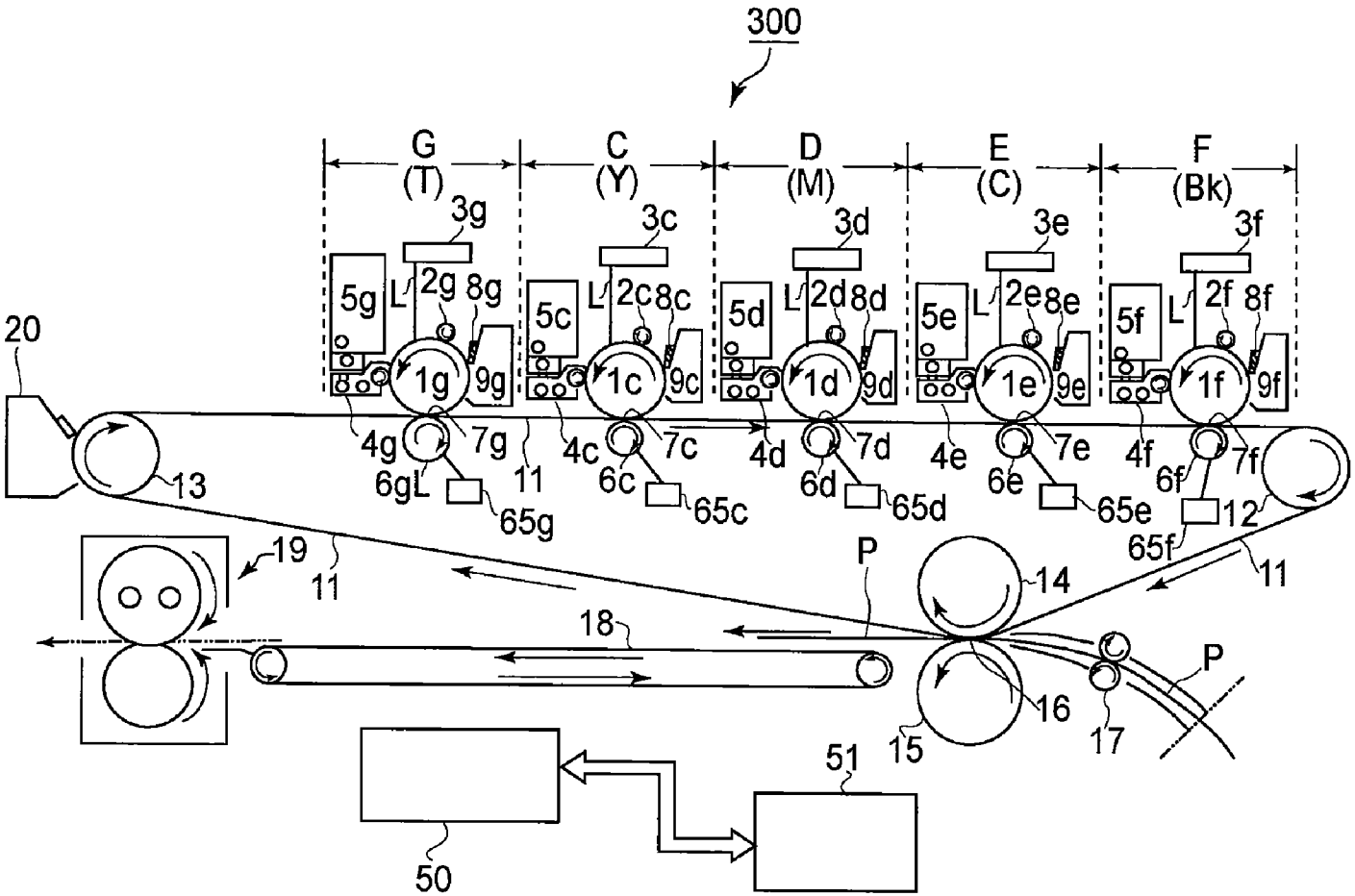

FIG. 12 is a schematic view for illustrating a general constitution of an image forming apparatus in this embodiment. In the image forming apparatus in this embodiment, the light color toner image forming stations A and B in the Second Embodiment are replaced with a transparent toner image forming station G. Other constitutions and control are identical to those in the Second Embodiment, so that means or members common to those shown in FIG. 11 are represented by reference numerals or symbols common to those shown in FIG. 11. Further, a constitution of members at the image forming station G is described by adding an alphabetic subscript g to reference numerals or symbols for the members at the image forming station G.

Referring to FIG. 12, the transparent toner image forming station G is a process cartridge for forming and carrying a transparent toner image of a transparent toner (T) on a photosensitive drum 1*g*. Also at the transparent toner image forming station G, the surface of the photosensitive drum 1*g* is electrically charged by a charging roller 2*g* and then exposed to laser light L by an exposure apparatus 3*g* to form an electrostatic latent image thereon. In a toner bottle (container) 5*g*, the transparent toner is accommodated and the electrostatic latent image on the photosensitive drum 1*g* is developed with the transparent toner to form the transparent toner image.

A primary transfer roller 6*g*L presses the intermediary transfer belt 11 against the photosensitive drum 1*g* by using the mechanism shown in FIG. 8 to form a primary transfer nip 7*g* between the intermediary transfer belt 11 and the photosensitive drum 1*g*. When the transfer voltage is applied from a transfer bias application power source 65*g* to the primary transfer roller 6*g*L, the transparent toner image on the photosensitive drum 1*g* is primary transferred onto the intermediary transfer belt 11 in the primary transfer nip 7*g*.

Onto the intermediary transfer belt 11 carrying thereon the primary-transferred transparent toner image, toner images of yellow, magenta, cyan and black are successively transferred. The intermediary transfer belt 11 onto which the toner images of five colors in total including the transparent toner image is moved to the secondary transfer nip 16 in which the toner images of five colors in total are secondary-transferred simultaneously onto the recording material P.

As described in JP-A Hei 08-220821, the principal object of addition of the transparent toner is glass uniformization at the image surface. In the case of forming the image through electrophotography, projections and recesses occur at a chromatic toner portion and an achromatic toner portion, so that non-uniformity of gloss in the image surface cannot be avoided. For this reason, by employing the transparent toner, the image is formed with the transparent toner at the achromatic toner portion, so that the projections and recesses in the image surface are removed to realize the gloss uniformization.

The transparent toner is also utilized to compensate for a difference in gloss between a toner deposition portion and a non-image portion to accomplish uniform gloss of the image as a whole. The projections and recesses on the recording material are removed and difference therebetween is alleviated to create gloss, so that glossiness of the entire image is improved. Accordingly, an amount of the transparent toner on the recording material (a transparent toner amount per unit area when a darkest color image is formed) requires to be a substantial amount for alleviating a difference in toner amount between the transparent toner amount and those for other colors. Specifically, in many cases, the transparent toner requires an amount equal to or larger than that of one of the chromatic toners.

Further, with respect to the transparent toner, in order to accomplish the above purpose, various methods such as a method in which a transparent solid image is formed on the entire image forming range including image and non-image portions (overcoating method) have been proposed. In this case, in order to uniformize a height of toner on the entire recording material, the transparent toner amount is evidently larger than those for other colors.

Accordingly, at the transparent toner image forming station G, the toner consumption amount is liable to be increased compared with those at the dark color toner image forming stations C to F. Further, in this embodiment, a maximum toner amount on the photosensitive drum 1 at the transparent toner image forming station G is 0.9 (mg/cm$^2$) which is substantially two times that (0.45 (mg/cm$^2$)) at the dark color toner image forming stations C to F.

In this embodiment, the maximum toner amount at the dark color toner image forming stations C to F is adjusted by changing an electric charge amount per unit weight of the toner used and a difference between the developing bias applied to the developing sleeve 42 shown in FIG. 2 during the development and a potential of the electrostatic latent image at the image portion (i.e., a developing contrast potential). At the dark color toner image forming stations C to F, the electric charge amount of the dark color toners is 30 (μC/g) and the developing contrast potential is 250 (V). On the other hand, at the transparent toner image forming station G, the charge amount of the transparent toner is 20 (μC/g) and the developing contrast potential is 350 (V).

Accordingly, the toner amount of the transparent toner image primary-transferred at the transparent toner image forming station G is liable to be increased compared with those of the dark color toner image is primary-transferred at the dark color toner image forming stations C to F. As a result, as shown in FIG. 6, the transfer efficiency at the transparent toner image forming station G is liable to be lowered compared with those at the dark color toner image forming stations C to F. Therefore, in this embodiment, it is desirable that the transfer efficiency at the transparent toner image forming station G is improved.

In other words, the transparent toner image is formed in a toner amount larger than those of the dark color toner images in many cases, so that on the same primary transfer condition, the transparent toner image is lowered in this embodiment compared with the dark color toner images. As a result, a possibility of an occurrence of image problem due to improper transfer of the transparent toner image is increased.

In this embodiment, the contact width Dtr and the transfer width Dph shown in FIG. 9 are increased in the primary transfer nip 7*g* at the transparent toner image forming station G compared with those in the primary transfer nips 7*c* to 7*f* at the dark color toner image forming stations C to F. Further, similarly as in the Second Embodiment, the diameter of the primary transfer roller 6*g*L is increased to adjust the contact width Dtr and the transfer width Dph in the primary transfer nips 7*g* and 7*c* to 7*f*. Table 3 below shows set values of the diameters of the primary transfer rollers and actually measured values of the contact widths Dtr and the transfer widths Dph.

TABLE 3

| Transfer roller | Diameter (mm) | Dtr (mm) | Dph (mm) |
|---|---|---|---|
| 6c to 6f | 16 | 2.1 | 2.3 |
| 6gL | 26 | 3.2 | 3.2 |

Specifically, the diameter of the dark color toner primary transfer rollers 6*c* to 6*f* is 16 (mm), whereas the diameter of the transparent toner primary transfer roller 6*g*L is 26 (mm). Further, all the contact pressures in the primary transfer nips 7*g* and 7*c* to 7*f* are 8N. As a result, the transfer efficiency of the transparent toner image is enhanced, so that it is possible to prevent lowering in image quality due to the improper transfer of the transparent toner image, unnecessary consumption of the transparent toner, and an increase in load on a drum cleaning apparatus 9*g*.

In this embodiment, similarly as in the Second Embodiment, the contact width Dtr and the transfer width Dph are adjusted by using the primary transfer different in diameter. However, similarly as in the First Embodiment, the contact width Dtr and the transfer width Dph may also be adjusted by adjusting the contact pressure in the primary transfer nips 7*g* and 7*c* to 7*f* or by combining the diameter adjustment with the contact pressure adjustment.

Fourth Embodiment

Figure 13:
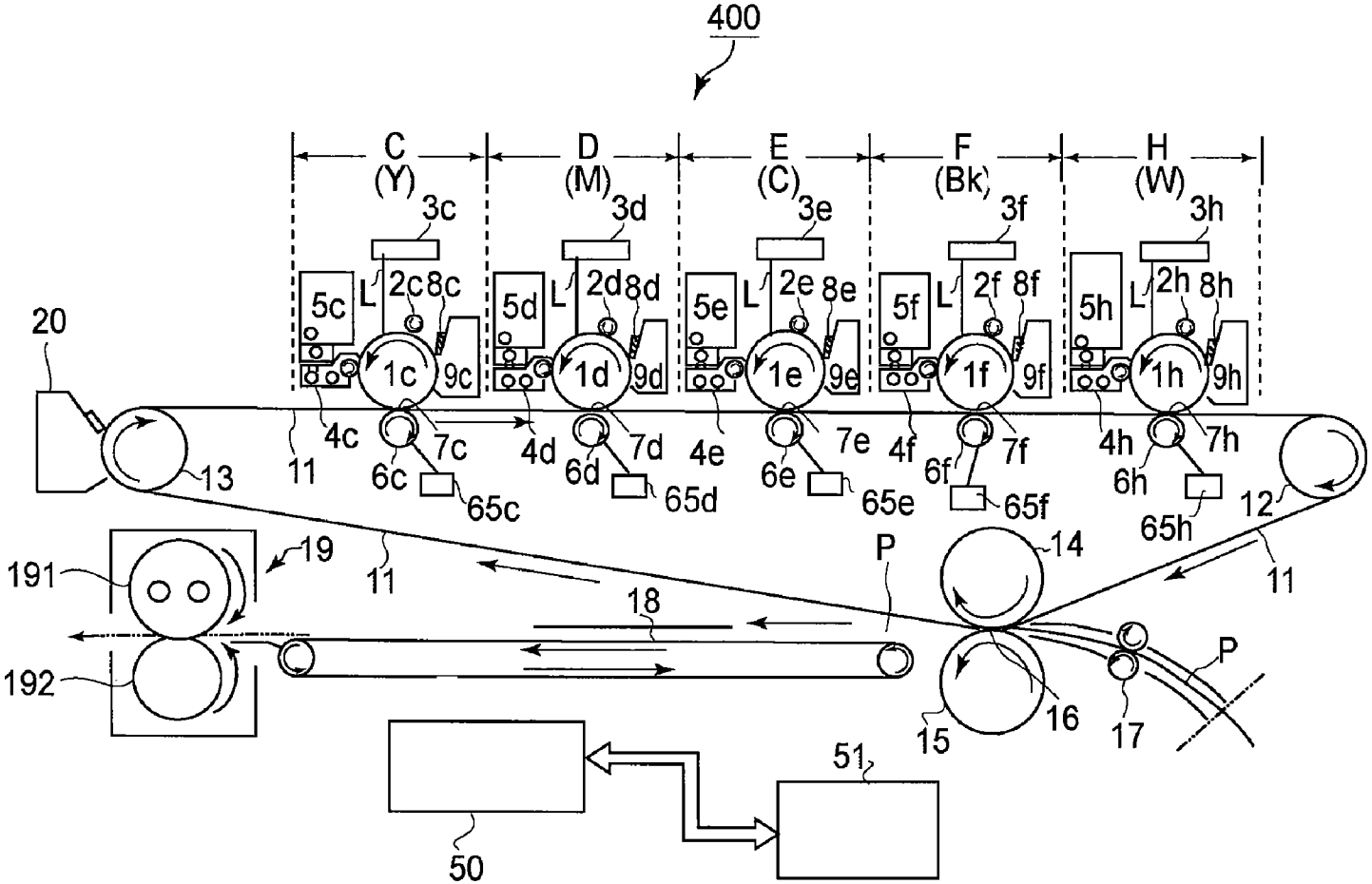

FIG. 13 is a schematic view for illustrating a general constitution of an image forming apparatus in this embodiment. In the image forming apparatus in this embodiment, the light color toner image forming stations A and B in the First Embodiment are replaced with a white toner image forming station H, and the white toner image forming station H is disposed downstream from the dark color toner image forming stations C to F. Other constitutions and control are identical to those in the First Embodiment, so that means or members common to those shown in FIG. 1 are represented by reference numerals or symbols common to those shown in FIG. 1. Further, a constitution of members at the image forming station H is described by adding an alphabetic subscript h to reference numerals or symbols for the members at the image forming station H.

Referring to FIG. 13, the white toner image forming station H is a process cartridge for forming and carrying a white toner image of a white toner (W) on a photosensitive drum 1*h*. Also at the white toner image forming station H, the surface of the photosensitive drum 1*h* is electrically charged by a charging roller 2*h* and then exposed to laser light L by an exposure apparatus 3*h* to form an electrostatic latent image thereon. In a toner bottle (container) 5*h*, the white toner is accommodated and the electrostatic latent image on the photosensitive drum 1*h* is developed with the white toner to form the white toner image.

A primary transfer roller 6*h* presses the intermediary transfer belt 11 against the photosensitive drum 1*h* by using the mechanism shown in FIG. 8 to form a primary transfer nip 7*h* between the intermediary transfer belt 11 and the photosensitive drum 1*h*. When the transfer voltage is applied from a transfer bias application power source 65*h* to the primary transfer roller 6*h*, the white toner image on the photosensitive drum 1*h* is primary-transferred onto the intermediary transfer belt 11 in the primary transfer nip 7*h*.

The white toner image is primary-transferred in a superposition manner onto the intermediary transfer belt 11 onto which toner images of yellow, magenta, cyan and black have been successively transferred. The intermediary transfer belt 11 onto which the toner images of five colors in total including white is moved to the secondary transfer nip 16 in which the toner images of five colors in total are secondary-transferred simultaneously onto the recording material P.

The principal object of addition of the white toner is that plain paper or recycled paper with a low degree of whiteness is made available as the recording material P for forming thereon a color image for source saving. In the case where the recording material P with the low degree of whiteness is used, coloring properties of the color toners of yellow (Y), magenta (M) and cyan (C) are changed from those of actual constitutes, so that the color of a color original image cannot be accurately reproduced. For this reason, in many color image forming apparatuses, an image quality is improved by using paper with a high degree of whiteness exclusively for the color image. However, such paper is expensive compared with an ordinary recording material P.

In this embodiment, as described in JP-A Hei 07-114241, the white toner is used in addition to the dark color toners of yellow, magenta, cyan and black. Before the image is formed on the recording material P, the entire surface of the recording material P is covered with the white toner. Further, the white toner image is, similarly as in the transparent toner image, usable for compensating for a stepped portion by the dark color toner images and for uniformizing glossiness of the entire image by being formed at a white portion onto which the dark color toner images are not transferred.

In this embodiment, a maximum toner amount of the white toner image formed on the photosensitive drum 1*h* is equal to that of the dark color toner images formed the photosensitive drums 1*c* to 1*f*. Both at the white toner image forming station H and the dark color toner image forming stations C to F, the maximum toner amount is 0.5 (mg/cm$^2$). However, a possibility that the white toner image occupies a larger area in the image than the dark color toner images is high, so that its influence on the resultant image quality due to a low transfer efficiency is larger than that by the dark color toner images. Further, the white toner image is formed in the maximum toner amount for obtaining the white surface, whereas a possibility that the dark color toner images are formed in the maximum toner amount is low since the dark color toner images have densities corresponding to a gradation level of the original image. Accordingly, the dark color toner images have the toner amount smaller than that of the white toner image.

In this embodiment, the contact width Dtr and the transfer width Dph shown in FIG. 9 are increased in the primary transfer nip 7*h* at the white toner image forming station H compared with those in the primary transfer nips 7*c* to 7*f* at the dark color toner image forming stations C to F. Further, similarly as in the First Embodiment, different elastic strengths of the springs 47*f* and 47*r* shown in FIG. 8 are employed between the white toner image forming station H and the dark color toner image forming stations C to F to set the contact width Dtr and the transfer width Dph. Table 4 below shows set values of the urging forces for the primary transfer rollers 6*c* to 6*f* and 6*h* and actually measured values of the contact widths Dtr and the transfer widths Dph in the primary transfer nips 7*c* to 7*f* and 7*h*.

TABLE 4

| Transfer roller | Urging force (N) | Dtr (mm) | Dph (mm) |
|---|---|---|---|
| 6c to 6f | 8 | 2.1 | 2.3 |
| 6h | 10 | 2.6 | 2.8 |

Specifically, the diameter of the dark color toner primary transfer rollers 6*c* to 6*f* and 6*h* is 18 (mm). Further, the urging forces for the primary transfer rollers 6*c* to 6*f* are 8(N), whereas the urging force for the primary transfer roller 6*h* is 10(N). As a result, the contact width Dtr is 2.1 mm and the transfer width Dph is 2.3 mm at the DC toner image forming stations C to F, whereas the contact width Dtr is 2.6 mm and the transfer width Dph is 2.8 mm at the white toner image forming station H.

In this embodiment, similarly as in the First Embodiment, the contact width Dtr and the transfer width Dph are adjusted by adjusting the contact pressures in the primary transfer nips 7*h* and 7*c* to 7*f*. However, similarly as in the Second Embodiment, the contact width Dtr and the transfer width Dph may also be adjusted by employing different diameters or materials for the primary transfer rollers or by a combination of the diameter with the contact pressure.

Fifth Embodiment

Figure 14:
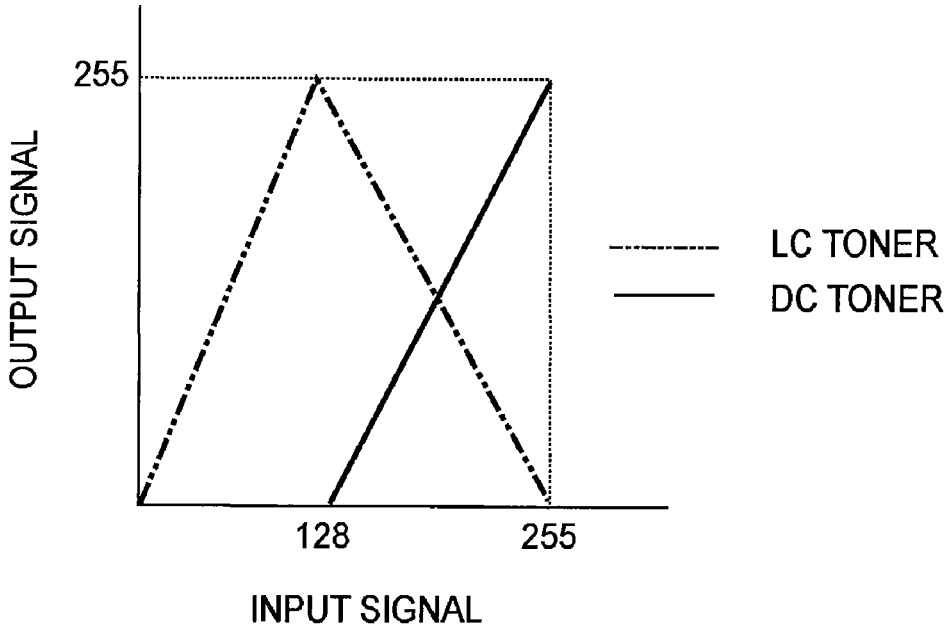
FIG. 14 is a graph showing a look-up table for assigning the light color toner and the dark color toner to an image density.

FIG. 14 is a graph showing look-up tables for assigning image densities to the light color toners and the dark color toners. FIG. 14 shows a look-up table for the light color toners (LC toner: a chain double-dashed line) and a look-up table for the dark color toners (DC toner: a solid line) when an image is formed by using the light color toners and the dark color toners. In FIG. 14, an abscissa represents a gradation value of the image before separation into those for the dark color toner and the light color toner and an ordinate represents a gradation value of the image after the separation into those for the dark color toner and the light color toner.

In this embodiment, the look-up tables shown in FIG. 4 are replaced by those shown in FIG. 14 to form the light color toner images and the dark color toner images. In this embodiment, therefore, description will be made with reference to FIGS. 1 to 3 and FIGS. 5 to 10 in combination with FIG. 14.

As shown in FIG. 14, maximum image output signal values for the light color toner images and the dark color toner images are 255, so that the maximum toner amounts at the light color toner image forming stations A and B and at the dark color toner image forming stations C to F shown in FIG. 1 are equal to each other. However, as described in the First Embodiment, the frequency of use of the light color toners in the maximum toner amount is higher than that in the case of the dark color toners, in order to improve the degree of graininess and prevent the pseudo contour at the high light portion. This is identical to the case of the white toner described in the Fourth Embodiment.

Further, the dark color toner images are noticeable in terms of disadvantages (scattering and graininess) on the output image due to the increase in the transfer width Dph shown in FIG. 9, so that the disadvantages can be problematic depending on an image to be formed. Further, the dark color toner images is low in the frequency of use in the maximum toner amount for image formation, so that the dark color toner images are liable to be transferred at a transfer efficiency higher than that of the light color toner images which is high in the frequency of use in the maximum toner amount.

Further, when the contact width Dtr and the transfer width Dph are increased in all the primary transfer nips 7*a* to 7*f*, a driving torque required for circularly moving the intermediary transfer belt 11 is increased, thus resulting in an increased electric power consumption during the operation.

For these reasons, in this embodiment, the contact width Dtr and the transfer width Dph are increased in the primary transfer nips 7*a* and 7*b* at the light color toner image forming stations A and B compared with those in the primary transfer nips 7*c* to 7*f* at the dark color toner image forming stations C to F. Further, similarly as in the First Embodiment, different elastic strengths of the springs 47*f* and 47*r* shown in FIG. 8 are employed between the light color toner image forming stations A and B and the dark color toner image forming stations C to F to set the contact width Dtr and the transfer width Dph. Table 5 below shows set values of the urging forces for the primary transfer rollers 6*a* and 6*b* and 6*c* to 6*f* and actually measured values of the contact widths Dtr and the transfer widths Dph in the primary transfer nips 7*a* and 7*b* and 7*c* to 7*f*.

TABLE 5

| Transfer roller | Urging force (N) | Dtr (mm) | Dph (mm) |
|---|---|---|---|
| 6c to 6f | 8 | 2.1 | 2.3 |
| 6a and 6b | 10 | 2.6 | 2.8 |

Specifically, the maximum toner amount at the light color toner image forming stations A and B shown in FIG. 1 is 0.5 ($mg/cm^2$) which is equal to that at the dark color toner image forming stations C to F. The diameter of the dark color toner primary transfer rollers 6*a* and 6*b* and 6*c* to 6*f* is 18 (mm). Further, the urging forces for the primary transfer rollers 6*c* to 6*f* are 8(N), whereas the urging force for the primary transfer rollers 6*a* and 6*b* is 10(N). As a result, the contact width Dtr is 2.1 mm and the transfer width Dph is 2.3 mm at the DC toner image forming stations C to F, whereas the contact width Dtr is 2.6 mm and the transfer width Dph is 2.8 mm at the light color toner image forming stations A and B.

In this embodiment, similarly as in the First Embodiment, the contact width Dtr and the transfer width Dph are adjusted by adjusting the contact pressures in the primary transfer nips 7*a* and 7*b* and 7*c* to 7*f*. However, similarly as in the Second Embodiment, the contact width Dtr and the transfer width Dph may also be adjusted by employing different diameters or materials for the primary transfer rollers or by a combination of the diameter with the contact pressure.

The numerical values mentioned in the above description of the First Embodiment to the Fifth Embodiment are merely exemplary and accordingly numerical values other than those mentioned may also be used as necessary.

The image forming apparatus in each of the preceding embodiments of the present invention is not limited to a full-color image copying machine but the present invention is also applicable to image forming apparatuses which are provided with two or more image forming stations (process cartridge), such as a printer or a facsimile apparatus.

The present invention may also employ a constitution of an image forming apparatus which does not employ an intermediary transfer medium but in which toner images formed on the image bearing members of the image forming stations are transferred in a superposition manner onto the surface of the same recording material by moving the recording material through the transfer nip of each of the two or more image forming stations one after another with the use of the recording material conveying belt or conveying drum. In this case, on the recording material, the toner images are directly formed in layers laminated in the transfer order, so that it is desirable that the toner images are transferred in reverse order (e.g., in the case of using the light color toners, the order is black, cyan, magenta, yellow, light cyan, and light magenta).

Further, the image forming apparatus is not limited to the tandem type image forming apparatus but may also employ such a constitution that a single photosensitive drum is provided with a plurality of developing apparatuses and toner images of respective colors (optionally including transparent and white) are primary-transferred successively on an intermediary transfer belt in a superposition manner. In this case, during primary transfer of a light color toner image, a transparent toner image and a white toner image, the contact width Dtr and the transfer width Dph can be controlled similarly as in the First Embodiment by changing a pressing force of the same primary transfer roller mechanically in two steps. Further, the contact width Dtr and the transfer width Dph may also be controlled similarly as in the Second Embodiment by switching and using primary transfer rollers different in diameter in a rotary manner.

The toner image forming mechanism at each of the image forming stations is not limited to a mechanism for an electrophotographic process but may also be a mechanism for an electrostatic recording process or a mechanism for a magnetic recording process, which employs a dielectric member or a magnetic member, respectively, as an image bearing member. In the electrophotographic process mechanism, the exposure apparatus as the latent image forming means may be provided inside or outside a process cartridge and may, e.g., be a light emitting diode (LED) array apparatus, a digital exposure apparatus made up of a combination of a light source and a liquid crystal shutter, or the like. It may also be an image projecting optical apparatus (analog image exposure apparatus) using color separation filters. Further, it is also possible to employ a constitution in which an electrostatic latent image corresponding to an objective image information is written and formed by selectively removing electric charges from the charge surface of the image bearing member, with the use of a charge removing means, such as a charge removing head in the form of a needle, an electron gun, or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 334601/2006 filed Dec. 12, 2006, which is hereby incorporated by reference.

What is claimed is:

1. An image forming apparatus comprising:

a first image carrying member for carrying a first toner image formed with at least one of a chromatic toner and a black toner;

a second image carrying member for carrying a second toner image formed with a transparent toner;

a first transfer member for electrostatically transferring the first toner image onto a transfer medium in a first transfer nip formed by bringing the transfer medium into contact with said first image carrying member; and a second transfer member for electrostatically transferring the second toner image onto the transfer medium in a second transfer nip formed by bringing the transfer medium into contact with said second image carrying member so that a length of the second transfer nip with respect to a movement direction of the second transfer member is longer than a length of the first transfer nip with respect to the movement direction.

2. An apparatus according to claim 1, wherein a contact pressure between said second transfer member and the transfer medium is larger than a contact pressure between said first transfer member and the transfer medium.

3. An apparatus according to claim 1, wherein each of said first transfer member and said second transfer member has a roller shape and a diameter of said second transfer member is larger than a diameter of said first transfer member.

* * * * *